United States Patent [19]

Rohde

[11] 3,933,267

[45] Jan. 20, 1976

[54] CONTAINER CLOSURE ASSEMBLY

[75] Inventor: Leroy H. Rohde, Malvern, Pa.

[73] Assignee: The West Company, Phoenixville, Pa.

[22] Filed: July 16, 1973

[21] Appl. No.: 379,819

[52] U.S. Cl. ..... 215/350; 215/363

[51] Int. Cl.[2] ..... B65D 53/00

[58] Field of Search ..... 215/343, 344, 345, 349, 215/350, 351; 215/352, 364, 347

[56] References Cited

UNITED STATES PATENTS

| | | | |
|---|---|---|---|
| 1,361,225 | 12/1920 | Bruns | 215/350 |
| 1,465,079 | 8/1923 | Hammer | 215/277 |
| 1,787,959 | 1/1931 | Scofield | 215/350 |
| 1,793,930 | 2/1931 | Hecht | 215/350 |
| 2,077,992 | 4/1937 | Eisen | 215/350 |
| 2,079,932 | 5/1937 | Fergusson | 215/351 |
| 2,105,031 | 1/1938 | Enkur | 215/350 |
| 2,270,424 | 1/1942 | Fabrice | 215/351 |
| 3,111,237 | 11/1963 | Hagmann | 215/349 |
| 3,122,254 | 2/1964 | Hagmann | 215/351 |
| 3,443,711 | 5/1969 | Orson | 215/349 |

FOREIGN PATENTS OR APPLICATIONS

| | | | |
|---|---|---|---|
| 683,521 | 1952 | United Kingdom | 215/350 |

*Primary Examiner*—George T. Hall
*Assistant Examiner*—R. E. Hart
*Attorney, Agent, or Firm*—Howson and Howson

[57] ABSTRACT

A container closure assembly for a container comprising an outer cap of generally cup-like form having a top and a skirt depending from the outer peripheral edge of the top and means for detachably securing the same over the opening in a container, an annular pocket formed in the skirt of the outer cap adjacent said top and a liner assembly consisting of at least a disc-like core of a resilient material, a shell for the core having a portion confronting the inside of the top of the outer cap and a locking portion to hold the core in said shell, said shell being of a predetermined dimension to permit limited axial movement in the pocket in the outer cap and anti-friction means between the shell and outer cap to permit relative rotation between the outer cap and the liner assembly.

4 Claims, 5 Drawing Figures

CONTAINER CLOSURE ASSEMBLY

The present invention relates generally to container closures and more specifically to a new and improved type of liner assembly for closures, particularly of the screw cap type.

The closure of the present invention has particular application to containers for medicaments or the like and more specifically to containers for intravenous solutions and irrigating water used in hospitals. In these instances, the closure is applied to the filled container and thereafter the assembly is autoclaved and then cooled. Some closures of conventional construction employing a liner material which may consist of a cork or rubber disc adhered to the inside of the top of the closure by means of adhesive and having a liner element confronting the opening in the container also adhered to the cork or rubber by means of an adhesive present certain problems when used in these applications. For example, it has been observed that when the closure is turned to remove it from the container, the liner facing has a tendancy to stick to the surface of the container finish and the sliding action of the liner over the finish of the container often results in slight lacerations to the liner facing due to the fact that the container finish has sharp or uneven surfaces. In this event the liquid product has a tendancy to penetrate the liner facing and saturate the resilient liner backing. This may result in contaminating the liquid product of the container. In the case of the usual pulp backing, the liquid then softens the adhesive that holds the liner to the closure and this combined with the tacky surface that develops when product dries on the top surface of the closure finish results in the liner sticking to the finish and pulling out of the closure. When the liner pulls out and adheres to the surface finish, it is necessary for the user to remove the liner by hand and thereby introduce the risk of contaminating the liquid product of the container.

With the foregoing in mind, an object of the present invention is to provide a closure having novel features of construction and arrangement obviating some of the disadvantages and drawbacks of the prior closures discussed above, particularly as it pertains to the use of the closure on containers for irrigating solutions and the like where it is essential to maintain the product in a sterile condition prior to use. To this end, the closure comprises an outer cap of generally cup-like form having an annular pocket formed at the juncture of the top and skirt for housing a "floating liner" consisting, in the present instance, of a core of a resilient material such as rubber having a first liner element confronting the product in the container made of an inert material, the core and first liner element being supported in confronting relation by a rolled edge shell or housing. The liner assembly may further include a disc-like second liner, made of a suitable low friction material and disposed between the rolled edge shell and the top of the cap. This arrangement permits the outer cap to be rotated relative to the liner assembly during the process of removing the cap from the container and obviates scoring of the liner on the rough or uneven surface finish of the container which as noted above may produce sticking of the liner to the container and/or contamination of the contents of the container. Additionally, the closure assembly may include a secondary seal adjacent the lower edge of the skirt of the cap and the bead on the exterior neck portion of the container to preclude the contamination of the container during the autoclaving and cooling process.

When the outer cap is turned to remove it from the container, the liner assembly remains stationary during the initial removal process due to the sliding action permitted between the secondary liner element and the top of the outer cap and when the liner assembly is engaged by the lower shoulder on the pocket it is lifted axially to displace it from the axial end face of the container. In this manner there is little or no sliding action between the liner assembly and the container during removal thereby eliminating the problem of piercing the liner assembly, which could result in contamination of the liquid product in the manner discussed above. Additionally, the liner assembly does not adhere to the container.

These and other objects of the present invention of the various features and details of the construction and function thereof are hereinafter more fully set forth with reference to the accompanying drawings.

Figure 1:
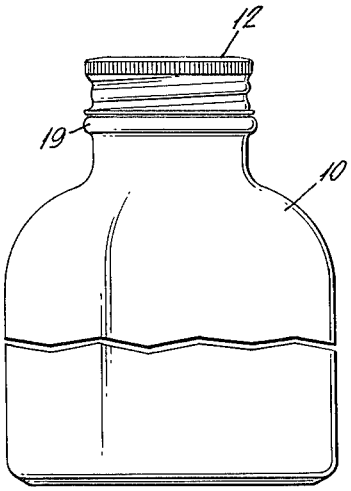
FIG. 1 is a side elevational view of a container with a closure constructed in accordance with the present invention applied thereto.
Figure 3:
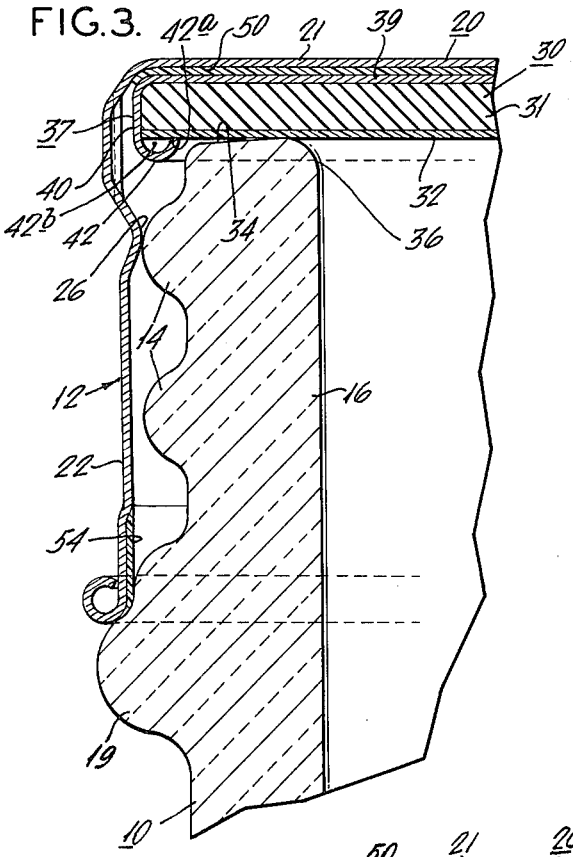
FIG. 3 is an enlarged fragmentary sectional view showing the closure initially applied to a container.
Figure 4:
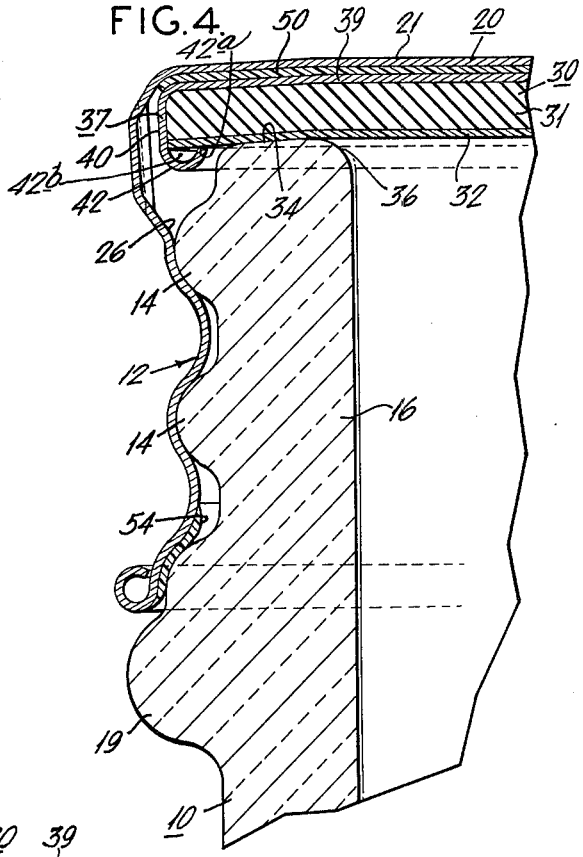
FIG. 4 is a view similar to FIG. 3 showing the cap with the rolled on threads.
Figure 5:
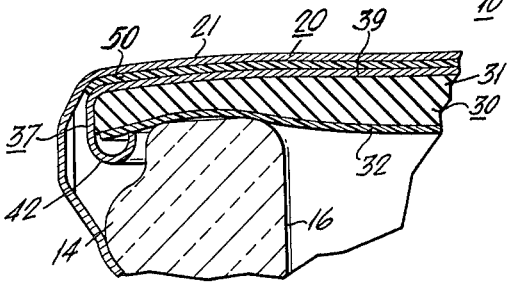
FIG. 5 is a fragmentary sectional view showing the engagement of the liner and the finish on the bottle with the cap or the closure fully applied.

Referring now to the drawing and particularly to FIG. 1 the thereof, there is illustrated a container such as a bottle, designated by the numeral 10, and a closure 12 applied thereto which is constructed in accordance with the present invention. The container 10 as illustrated in FIGS. 3 and 4 has conventional spiral screw threads 14 formed on the outer surface of the neck 16 and a bead 18 at the lower terminal edge of the spiral screw threads 14. The container illustrated also includes an annular bead 19 on the exterior of the neck below the spiral screw threads 14. In the present instance, the outer cap is preferably made of a thin guage metal such as aluminum wherein the threads conforming to the container are formed after the cap is applied to the container by automatic roll-on capping equipment. However, the outer cap may have preformed threads and be made, for example, of a plastic material. Additionally, even though the closure of the present invention is illustrated in connection with a closure having a spiral screw thread finish, it is to be understood that the closure of the present invention has application to other types of containers having other means for retention of the closure.

Figure 2:
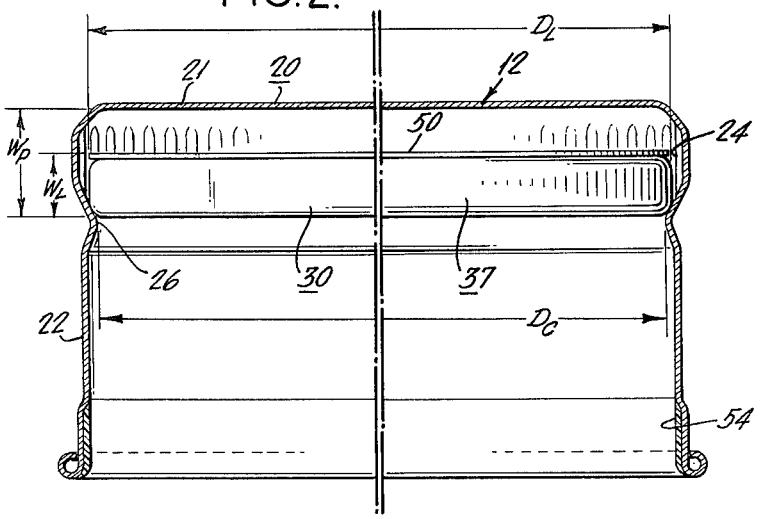
FIG. 2 is an enlarged transverse sectional view of the closure prior to application to a container.

In the present instance, the closure 12 comprises an outer cap member 20 of generally cup-like form which may be made of a thin guage metal such as aluminum and includes an annular top 21 having a skirt 22 depending from its outer peripheral edge which prior to application to a container is straight sided and which may be rolled or spun by automatic roll-on capping equipment to conform to the threads 14 on the container as illustrated in FIG. 4. In the illustrated embodiment, the outer cap member 20 has an annular pocket 24 between the top 20 and skirt 22 which is provided with a knurled finish to assist the user in turning the closure. The pocket 24 as illustrated has a circumferential inwardly extending offset portion defining a shoulder 26, the inner diameter Dc of which is smaller than the maximum diameter DL of the liner assembly 30 so that the liner may be snapped into place in the pocket in the manner shown in FIG. 2 and retained therein when the closure is processed by automatic capping equipment to apply the same to the container. Additionally, the axial depth Wp of the pocket is greater than the maximum depth of $W_1$ of the liner assembly to permit the liner assembly to "float" in the pocket for ease of removing the closure without damaging the liner assembly as discussed below.

The liner assembly 30 comprises a disc-like core 31 made of a resilient material such as rubber, a first liner element 32 made of an inert material compatable with the contents of the container confronting the inner face of the core 30 and adapted to directly engage the axial end face 34 of the container adjacent the opening 36 therein and a shell or housing 36 which may be made of metal such as thin guage aluminum. A suitable material for the first liner element 32 is Gilsonite, an oleo-resinous varnish sheet material. The shell 36 is of generally inverted cup-like form having a disc-like top 39 and a skirt 40 depending from the outer periphery of the top and a rolled-in flange 42 which extends radially inwardly to encapsulate and retain the first liner 32 and the resilient core 31 in the assembled relation. The flange 42 as illustrated is rounded so that its terminal edge 42*a* confronts and engages the liner element 32 radially inwardly of its outer circumferential edge. This construction provides several advantages in closures of this type. For example, the raw edge of the core 31 and first liner element 32 are completely encapsulated in the shell and the raw outer terminal edge of the flange confronts and engages in the liner 32 thereby minimizing the risk of free particulate matter from these edges contaminating the liquid product. Additionally, the flange 42 acts as a pilot to center the liner relative to the container to insure proper seating against the axial end face of the container to provide a good seal. Further, the circumferential chamber 42*b* provided by the rolled flange provides an expansion area for the core 31 and liner element 32 when the elements are compressed as a result of application to the container.

In the present instance, the liner assembly further includes a second liner element 50 made of a low friction material such as polyethylene, which is of disc-like form and is disposed between the housing and top of the outer cap member. This second liner element 50 serves to permit relative rotation of the outer cap and liner assembly when the outer cap is initially rotated thereby precluding damage to the liner element engaging the finish of the container. In lieu of the second liner element, the housing may be coated with a low friction material such as a low friction lacquer to provide the same action described above.

The closure is also provided with a secondary seal consisting in the present instance of a flowed-in liner 54 in an annular recess in the lower edge of the skirt of the outer cap which liner 54 engages the bead on the exterior neck portion of the container below the spiral threads.

In the use of the closure of the present invention on containers for medicaments such as an intravenous solution or irrigating water, the container is filled with the particular liquid and the closures are applied over the opening in the container, for example, by automatic roll-on capping equipment whereby in the case of a container having spiral thread finish, and a bead on the neck as illustrated in the drawings, the skirt of the outer cap is rolled to conform to threads on the container and simultaneously the lower edge of the skirt is sealed against the bead to provide the secondary seal, the primary seal being engagement of the liner assembly against the axial end face of the container as shown in FIG. 4. The automatic roll-on capping equipment includes a member engageable with the top of the outer cap adapted to apply head pressure to the cap to insure firm seating of the liner assembly against the axial end face of the container prior to formation of the threads on the container. Note the core 31 has sufficient resiliency to accomodate the application of head pressure to the closure. Application of head pressure prevents loss of contents and also eliminates the possibility of outside contamination during the capping process. Thereafter the assembled units are autoclaved for a predetermined period of time and then permitted to cool. It is noted that the secondary seal 54 insures against ingress of any contaminants into the container during the autoclaving and cooling process.

Now when it is desired to use the contents of the container, the outer cap is simply rotated in a direction to remove it from the container whereby the liner assembly remains seated on the top of the container until the annular shoulder defining the lower portion of the pocket engages the outer peripherial edge of the liner assembly to lift it axially from the container during continued rotation of the outer cap. It is noted that during ititial removal of the outer cap, the secondary disc of low friction material or the low friction coating on the face of the rolled edge disc confronting the inside top of the outer cap permits rotation of the outer cap relative to the liner thereby precluding any damage to the liner material resulting from rotation of the liner assembly relative to the container.

In view of the above, it is submitted that the closure of the present invention has several assembly and functional advantages over prior closures used for similar purposes. For example, no elements of the liner assembly will be lost in handling. Additionally, the correct number and order of the elements of the assembly will always be present. Furthermore, closure removal torque is significantly reduced and as noted previously in removing the closure, there is little or no sliding action between the liner assembly and container thereby eleminating the problem of piercing or puncturing the liner which could result in the contamination of the liquid product.

We claim:

1. A container closure assembly for a container comprising an outer cap of generally cup-like form having a top and a skirt depending from the outer peripheral edge of the top, an annular pocket formed in the skirt of the cap adjacent said top, a floating liner assembly mounted in said pocket including a disc-like core of resilient material, a first liner element confronting one face of the core, a cup-like shell having a top portion overlying the other face of the core, and a turned in locking flange engageable with the first liner element adjacent the periphery thereof, and a second liner element made of a low friction material disposed between the inner surface of the top and the top portion of said shell to facilitate rotation of said shell and cap relative to one another when said members are in pressure applying relation.

2. A container closure as claimed in claim 1 including a circumferentially extending flowed in liner on the interior of the skirt adjacent the lower terminal edge thereof.

3. A container closure as claimed in claim 1 wherein said outer cap and shell are made of a thin guage aluminum.

4. A container closure as claimed in claim 1 wherein the locking portion of the shell comprises a turned-in arcuate flange, the inner terminal edge of said flange pressing said first liner element along a circumferential line extending radially inwardly from the peripheral edge of said core and forming an annular chamber encapsulating the outer terminal edge of said core and first liner element.

* * * * *